United States Patent [19]

Altmayer

[11] 4,167,011

[45] Sep. 4, 1979

[54] RADIO ANTENNA CONSTRUCTION

[75] Inventor: John Altmayer, Cape Coral, Fla.

[73] Assignee: Hustler, Inc., Kissimmee, Fla.

[21] Appl. No.: 849,180

[22] Filed: Nov. 7, 1977

Related U.S. Application Data

[63] Continuation-in-part of Ser. No. 753,318, Dec. 22, 1976, Pat. No. 4,117,493.

[51] Int. Cl.[2] ..... H01Q 9/00; H01Q 1/00; H01F 27/30

[52] U.S. Cl. ..... 343/749; 343/752; 343/722; 336/197

[58] Field of Search ..... 343/722, 745, 749, 750, 343/752, 867, 868; 336/197, 207

[56] References Cited

U.S. PATENT DOCUMENTS

| | | | |
|---|---|---|---|
| 1,959,543 | 5/1934 | Osnos | 336/207 |
| 2,311,472 | 2/1943 | Roosenstein | 343/745 |
| 2,748,386 | 5/1956 | Polydoroff | 343/787 |
| 2,771,386 | 11/1956 | Merz et al. | 336/207 |
| 3,495,209 | 2/1970 | Engle | 343/787 |
| 3,689,928 | 9/1972 | Felsenheld | 343/752 |
| 3,760,315 | 9/1973 | Hartmann | 336/207 |

*Primary Examiner*—Alfred E. Smith
*Assistant Examiner*—Harry E. Barlow
*Attorney, Agent, or Firm*—Meyer, Tilberry & Body

[57] ABSTRACT

An impedance matching transformer and isolation inductance construction for a vertical-end fed radio antenna which enables simple manufacturing tecniques to obtain uniformity of impedance matching from one antenna to the next and which enables the use of a sintered magnetically permeable core of a length longer than three inches. The impedance matching transformer includes a two turn primary and insulating means accurately spacing these two turns. The core is made up of a plurality of relatively cylindrical formed short core elements from sintered magnetically permeable material in end to end relationship. Very thin plastic spacers are interposed between the adjacent ends of the core elements and between the sides of the elements and the housing to prevent chipping.

6 Claims, 4 Drawing Figures

RADIO ANTENNA CONSTRUCTION

In some respects, the invention constitutes an improvement on the antenna described in and this application is a continuation-in-part of U.S. Pat. application Ser. No. 753,318, filed Dec. 22, 1976, now U.S. Pat. No. 4,117,493, the disclosure of which is incorporated herein by reference.

This invention pertains to the art of radio antennas and more particularly to the construction of the impedance matching transformer and the isolating feed line impedance for an end fed radiating element.

In said application, there is described an elongated radiating element having an impedance matching transformer at one end thereof and an isolating impedance for the coaxial cable feedline comprised of the coaxial cable being in the form of an elongated multi-turn coil having a magnetically permeable core with one end of the cable connected to the impedance matching transformer and the other end leading away from the antenna to a transmitter.

The impedance matching transformer consists of a multi-turn secondary having one terminal connected to one end of the radiating element and a surrounding two turn coil having its terminals connected to the core and shield of the coaxial cable. The transformer matches the low impedance of the cable to the high impedance of the radiating element and the coaxial cable coil has sufficient impedance as to isolate the coaxial feedline leading to the transmitter from the radiating element.

In the course of manufacturing such antenna in production, difficulty was experienced in obtaining uniformity in the impedance transformation ratio of the transformer due to, as the present invention determined, what appeared to be inconsequential variations in the spacing of the turns of the external two turn primary winding.

Further, in the manufacture of the magnetically permeable core for the coaxial cable coil, it was found impossible to manufacture sintered magnetically permeable cores of a length in excess of two inches which were at the same time, straight enough to slip into the housing supporting the coaxial cable coil.

The present invention provides an improved arrangement for the primary of the impedance matching transformer and an improved arrangement for the magnetically permeable core which overcomes all of the above referred to difficulties and provides a radio antenna which can be manufactured so as to have uniform electrical characteristics from one antenna to the next and wherein the problems of manufacturing elongated straight sintered magnetic cores are eliminated.

In accordance with the invention, the primary winding for the impedance matching transformer is comprised of at least two axially spaced turns in combination with insulating means engaging both axially facing sides of the turns for accurately determining in the course of manufacture, the axial spacing of these turns. Such insulating means in the preferred embodiment include a split ring of insulating material of a predetermined width which engages the opposed sides of the primary turns and a plurality of hooked members which fit over the two turns and bear against the oppositely facing or outer sides of the turns to press the turns against the spacer member.

Further in accordance with the invention, the housing for the coaxial cable winding and core is in excess of 4 inches and the magnetically permeable core is made up of a plurality of relatively short core elements of sintered material in end to end relationship, the core elements having non-metallic flexible spacing means between the adjacent ends and preferably between the sides of the core elements and the inside of the housing so as to prevent chipping of the brittle core elements. Resilient means are provided for maintaining the core elements in close fitting abutting end to end relationship.

The principal object of the invention is the provision of a new and improved impedance matching transformer construction and isolating choke construction for the feed arrangement for end fed radio antennas.

Another object of the invention is the provision of a new and improved arrangement for accurately spacing the primary turns of the impedance matching transformer so that all antennas manufactured will have substantially identical electrical characteristics.

A further object of the invention is the provision of a new and improved sintered core arrangement wherein the problems of manufacturing elongated straight sintered magnetically permeable cores are eliminated.

Another object of the invention is the provision of a new and improved core for an isolating inductance for the feedline of a radio transmitting antenna wherein the core is made up of plurality of sintered magnetically permeable members in relatively short lengths and in end to end relationship.

The invention may take physical form in certain parts and arrangements of parts, a preferred embodiment of which will be described in this specification and illustrated in the accompanying drawing which is a part hereof and wherein.

Figure 1:
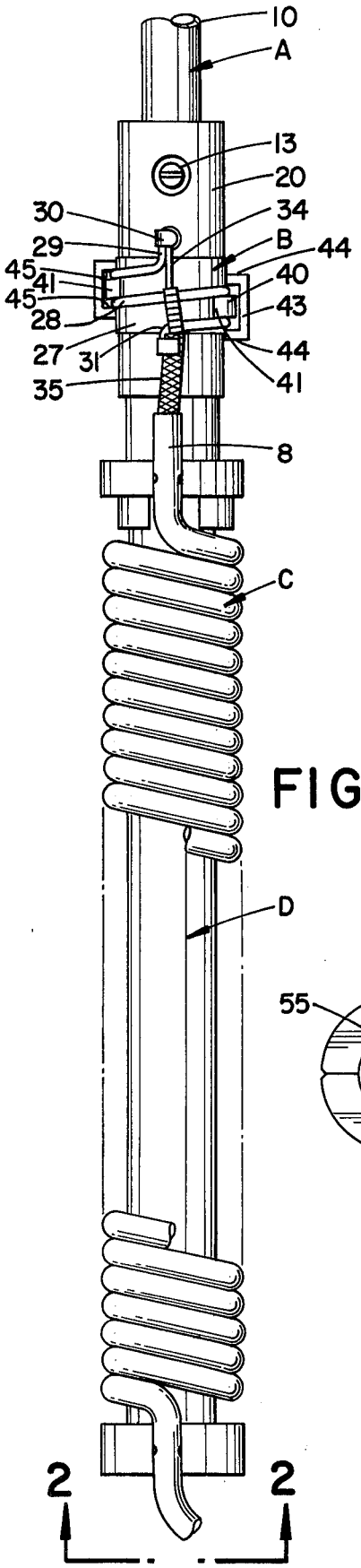
FIG. 1 is a side elevational view with portions broken away illustrating a preferred embodiment of the invention.
Figure 4:
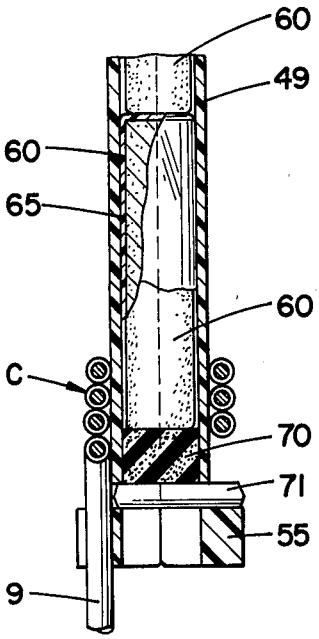
Figure 2:
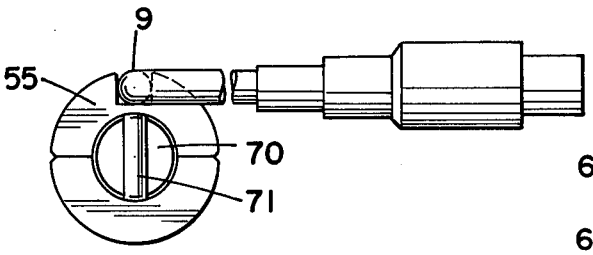
FIG. 2 is an end view of FIG. 1 taken approximately in the line 2—2 thereof.

Referring now to the drawings wherein the showings are for the purposes of illustrating a preferred embodiment of the invention only, and not for the purposes of limiting same, the figures show the bottom of a generally rigid radiating element A extending upwardly from an impedance matching transformer B, and a feed line isolating impedance comprised of a multi-turn coil C of coaxial cable wound around a generally cylindrical housing D which has disposed on the inside thereof a magnetically permeable core E. The upper end 8 of the coaxial cable C connects to the impedance matching transformer B and the lower end 9 extends for indeterminate length to a radio transmitter and receiver usually of the transceiver type.

The radiating element A forms no part of the present invention and is shown only for the purposes of illustration. It is generally comprised of an elongated tube 10 of aluminum the lower end of which is telescoped into an upward cylindrical extension 12 on the housing D and fastened in in place by any suitable means such as the threaded bolt 13 and nut 14, which bolt 13 is in electrical contact with the tube 10.

The impedance matching transformer B is comprised generally of: a cylindrical sleeve 20 of insulating material telescoped over the cylindrical housing extension 12; and a secondary winding 21 wound in a wide groove in the surface of the sleeve 20. This winding has a pair of terminals, the upper one of which 23 is soldered to a lug 24 held under the nut 14, and thus against the outside of the sleeve 20. This provides an electrical connection from the upper terminal 23 of the secondary winding 21 to the lower end of the radiating element A. The lower terminal 25 of the winding 21 is connected to a soldering lug 26 staked to the outside of the sleeve 20 below the coil 21 and on the diametrically opposite side from the lug 24. The coil 21 may have any number of desired turns in order to accomplish the desired impedance matching relationship but in the preferred embodiment is comprised of 16 and ½ close wound turns of number 22 gauge enameled copper wire. Around this secondary is a layer of insulating tape 27 and around this tape is a coil 28 having an upper terminal 29 connected to a soldering lug 30 fastened to the side of the sleeve 20 above the secondary winding 21 and a lower terminal 31 connected to the soldering lug 26. This winding 28 again may have any number of desired turns but in the preferred embodiment is comprised of two axially spaced turns with the terminals 29, 31 in vertical alignment. The upper end 8 of the coaxial cable forming the coil C has its inner conductor 34 soldered to upper lug 30 and its braid 35 soldered to lower lug 26.

As described in my above referred to co-pending application Ser. No. 753,318, the impedance matching ratio of the transformer B is adjusted by means of a longitudinally split elongated aluminum sleeve supported on a coaxial plastic housing and vertically slidable thereon in the vicinity of the transformer B. As this sleeve is vertically adjusted, the impedance transformation ratio of the transformer B is varied and in commercial embodiments of the antenna described therein, it has been possible to reduce the standing wave ratio on the coaxial cable feed line to the antenna to 1.0–1 or very close thereto. In practice, it is desirable that this sleeve be in the same physical location to the transformer B from one antenna to the next. In this way, it is possible to instruct the installer of the antenna to position the sleeve at a stated distance relative to the transformer (or some other fixed reference point on the antenna) with the result that the standing wave ratio is very close to the optimum value. In practice, it was found that this was not the case; research leading to the present invention indicated that minute variations in the spacing of the individual turns of the primary winding 28 resulted in rather wide variations in the impedance matching ratio of the transformer B.

In accordance with the invention, rigid insulating means are provided which engage both axial sides of the wire forming the primary winding 28 so as to accurately and definitively space these wires to a predetermined and repeatable amount. Such means may take a number of different forms but in the embodiment shown, comprise a split C-shaped ring 40 with the ends 41 axially offset. This ring 40 fits between the two turns of the primary winding and accurately spaces these turns. To hold the sides of the turns in physical engagement with the axially facing sides of the ring 40, a pair of U-shaped clips 43 having a pair of legs 44 are provided. The legs 44 have slightly converging opposed surfaces 45 which pressure engage the axially facing outer surfaces of the wire forming the winding 28 and press this wire into pressure engagement with the axially facing surfaces of the ring 40. Preferably, two or more of these clips 43 are used.

Using the spacer ring 40 and clips 43, it has been found possible to obtain exact uniformity of the transformer B from one antenna to the next in quantity production such that by specifying the exact location of the adjusting sleeve, the antenna input impedance almost matches the coaxial cable impedance and minimal standing ratios approaching 1.0–1 can be obtained by any user of the antenna simply using a ruler to locate the sleeve.

The housing D in the embodiment shown is in the form of an elongated cylindrical wall 49 having an interior cylindrical surface 50 which defines an interior bore 51 and an external cylindrical surface 52 on which the coil C of coaxial cable is supported. Radially extending abutments 54, 55 at the upper and lower ends of the housing D limit the length of the coil C and hold the turns thereof in tight fitting side by side engagement. The housing D is assembled from two semi-cylindrical halves and pins 56 on one half engaging in mating holes in the other half to hold the halves in alignment.

Figure 3:
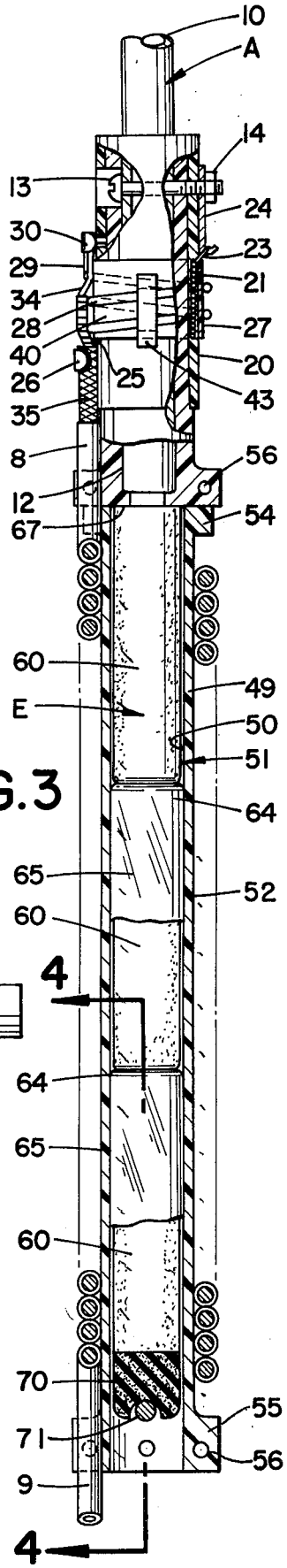
FIG. 3 is a side view of FIG. 1 with additional portions thereof broken away showing the core construction; and, FIG. 4 is a cross sectional view of the lower end of FIG. 3 and of FIG. 2 taken approximately on the line 3—3 thereof.

In the preferred embodiment there are thirty-one turns of RG58/U coaxial cable and the lower end 9 of the coil C passes through an axially extending groove in the flange 55 substantially as is shown in FIGS. 1 and 3.

To increase the inductance of the coil C and as described in my co-pending application, the core E of magnetically permeable material is provided in the bore 51 of the housing D. This core must have low loss characteristics at the desired frequency of operation inasmuch as the antenna is intended to be operated at frequencies above 3.5 MHz and preferably at around 21.0 MHz and higher. Thus, the core material must be of a sintered type, that is to say, magnetically permeable particles are pressed together and bound by heating them to elevated temperatures. The axial length of the coil C and thus the length of the core E in the preferred embodiment is approximately 6 and ¾ inches. The inner diameter of the coil C is approximately 0.675 inches and the diameter of the bore 51 is approximately 0.546 inches. In attempting to purchase sintered magnetic material having a length of 6 and ¾ inches and an external diameter just under 0.546 inches (so that the magnetically permeable material could be slipped into the bore 51), it was found that using conventional sintered manufacturing processes, it was impossible to manufacture a sintered core member six inches long which was straight enough to easily slide into the bore 51, that is to say, the sintering process produced a curved or crooked member which could not be assembled in the housing.

Accordingly and in accordance with the invention, the core E is in the form of a plurality of relatively short core elements 60 which are positioned in end to end relationship in the bore 51 with the total length equal to approximately 6 and ¾ inches. In the preferred embodiment, these core elements 60 have a length of approximately 2 inches although this dimension may be more or less depending upon the abilities of the manufacturer to produce these short core elements such that the amount of crookedness is not in excess of the clearance between the sides of the core element and the inwardly facing walls of the bore 51.

A further problem arose with the use of such short core elements 60 in that the sintered core material is extremely brittle and there was a tendency for the abutting ends of the core elements to chip or fragment either during assembly or when the antenna was being shipped.

In accordance with the invention, means are provided between the abutting ends of the individual core elements 60 which are relatively soft and will cushion the ends and will not in themselves shatter, crack or fracture. This means may take a number of different forms but in the preferred embodiment are comprised of thin sheets 64 of plastic material such as "Saran" wrap having an area greater than the cross sectional area of the core elements so that when a sheet is positioned against an end of a core element 60 and the core element is inserted into the end of the bore 51, the excess area of the plastic sheets will wrinkle and extend along the sides of the core elements as at 65 cushioning them against breakage due to sideward forces. In the preferred embodiment, two of such sheets of plastic are employed.

This "Saran" wrap has a thickness of approximately 0.001 inches. As a result, there is a minimum or practically no air gap between the adjacent axially abutting ends of the individual core elements. Other plastics or even a cured liquid coating could be employed.

To hold the core elements in firm abutting relationship and in pressure engagement against the shoulder 67 at the upper axial end of the bore 51, resilient means are provided. This may take a number of different forms but in the embodiment shown, is a short cylindrical plug 70 of sponge rubber in abutting engagement with the lower end of the lower core element and held in compression by means of a pin 71 extending through holes in the wall 49 and transversely across the bore 51 at the lower end thereof. Obviously, this plug 70 could be located at any point along the bore 51, the position shown in the FIG. 3 being that preferred.

It will thus be seen that an impedance matching transformer for feeding the end of a radiating element has been described which enables tolerances to be held so closely in a critical area that each transformer when assembled with its antenna will have the same electrical characteristics whereby the physical location for the adjusting means for such transformers on a plurality of antennas manufactured at different times can be accurately pre-established for the installer of the antenna.

Further, an arrangement has been provided wherein the isolating impedance for the feedline can employ a magnetically permeable core formed from sintered magnetically permeable material and the problems of manufacturing an elongated core member sufficiently straight so as to be inserted into a rigid cylindrical housing is overcome and problems of chipping of the core members are eliminated.

The invention has been described with reference to a preferred embodiment. Obviously, modifications and alterations will occur to others upon a reading and understanding of this specification and it is my intention to include all such modifications and alterations insofar as they come within the scope of the appended claims.

Having thus described my invention, I claim:

1. In a radio antenna including:

(a) an elongated generally rigid radiating element;

(b) a first multi-turn winding positioned at one end of said element and having a pair of terminals, one being connected to the adjacent end of said element;

(c) a second winding closely surrounding said first winding and having at least two axially spaced turns and a pair of terminals;

(d) a coaxial cable having an inner conductor and an outer shield conductor each connected to the respective terminals of said second winding said outer shield conductor also connected to one of said terminals of said first multi-turn winding; the improvement which comprises:

(e) an insulating member in the shape of a split ring with the ends axially offset positioned between said second winding spaced turns;

(f) a plurality of circumferentially narrow axially extending clamping members having hooks at the ends, said clamping members being positioned over the outside of said second winding spaced turns and said split ring, the hooks engaging the outwardly facing sides of said second winding spaced turns and pressing the opposite sides against the sides of said split ring.

2. The improvement of claim 1 wherein said insulating member has a pair of axially outwardly facing surfaces.

3. In a radio antenna including:

(a) an elongated generally rigid radiating element;

(b) a first multi-turn winding positioned at one end of said element and having a pair of terminals, one being connected to the adjacent end of said element;

(c) a second winding surrounding said first winding and having a pair of terminals;

(d) a tubular housing, having one end adjacent said first and second windings and another end remote therefrom and from said radiating element;

(e) a coil of coaxial cable around the outside of said housing, said cable having an inner conductor and an outer shield conductor with the ends adjacent said windings being connected to respective terminals of said second winding; said outer shield conductor also connected to one of said terminals of said first multi-turn winding;

(f) a magnetically permeable core inside of said housing and having a length generally the same as the axial length of said coaxial cable coil and a diameter so as to slide freely into said tubular housing;

(g) the improvement which comprises; said core being comprised of a plurality of short lengths of sintered magnetically permeable material in end to end relationship with thin soft non-metallic means positioned between the adjacent ends of said short lengths.

4. The improvement of claim 3 wherein said housing has an interior abutment at the end adjacent said windings and a removable abutment at the opposite end and resilient means between one of said abutments and said core.

5. The improvement of claim 3 wherein said non-metallic means comprise pieces of thin plastic sheet.

6. The improvement of claim 5 wherein the area of said plastic sheet is greater than the cross sectional area of said short length whereby said plastic sheets extend axially along the sides of the said short lengths.

* * * * *